United States Patent [19]

Ferralli

[11] 4,264,642

[45] Apr. 28, 1981

[54] DEPOSITION OF THIN FILM ORGANIC COATINGS BY ION IMPLANTATION

[75] Inventor: Michael W. Ferralli, Erie, Pa.

[73] Assignee: Lord Corporation, Erie, Pa.

[21] Appl. No.: 967,946

[22] Filed: Dec. 11, 1978

[51] Int. Cl.[3] ..... B05D 3/06

[52] U.S. Cl. ..... 427/38; 427/255; 427/255.2; 427/255.6

[58] Field of Search ..... 427/38–42, 427/255, 255.1, 255.6

[56] References Cited

U.S. PATENT DOCUMENTS

| | | | |
|---|---|---|---|
| 3,912,826 | 10/1975 | Kennedy | 427/38 X |
| 4,096,315 | 6/1978 | Kubacki | 427/41 |

*Primary Examiner*—Bernard D. Pianalto

*Attorney, Agent, or Firm*—John A. Gazewood

[57] ABSTRACT

Thin film organic coatings of a polymeric nature are deposited on and merged into substrate surfaces by ion implantation of ionized organic monomers.

49 Claims, 2 Drawing Figures

DEPOSITION OF THIN FILM ORGANIC COATINGS BY ION IMPLANTATION

This invention relates to organic polymeric coating and to the thin film deposition of such coatings by ion beam implantation.

Organic polymeric coatings have been extensively employed on metal, glass, ceramic, wood, fiber and elastomeric substrates to enhance aesthetics and protect the substrate from environmental damage. Generally, such coatings have been applied from solvent and aqueous carrier systems with substantially every organic material, polymeric and monomeric, which is capable of forming a continuous film having been employed to some extent. High solids coating compositions, in which the inert solvent or aqueous carrier medium is present in amounts not exceeding about 30 percent, based on total resin content, are also well-known and are coming into ever increasing usage. With such coatings, film thickness is generally on the order of one mil or more, with adhesion between the substrate and the coating film being due primarily to physical attachment or chemical reactions at the interface. While such compositions can provide eminently satisfactory performance in most applications, there are significant areas in which these thick film coatings cannot or do not perform satisfactorily. In many instances, the replacement of thick film coatings by thin film coatings ranging in thickness from a monomolecular layer to several thousand angstroms has been effective in overcoming at least some of the deficiencies of the thick film coatings.

Such thin films can be deposited in several ways. For example, the conventional coating systems can be diluted to total resin solids contents on the order of one percent or less and applied in a conventional manner, as by spraying, brushing, dipping or roller coating. However, thin films applied from such infinitely diluted solutions, emulsions or dispersions do not always have the required ultimate film properties and it is extremely difficult to obtain films of uniform thickness. In addition, film continuity is often disrupted resulting in junking of parts or additional coating steps. Adhesion of such conventionally applied thin film coatings is based on essentially the same mechanisms as is adhesion of thick film coatings. In each instance, the coating is a distinct and separate entity on the surface of the substrate.

Thin film organic coatings can also be deposited by diffusion, evaporation and plasma processes. Such processes can provide improved thin film coatings especially with respect to film continuity, but are not without their peculiar problems. Both diffusion and evaporative processes generally require that the substrate be heated to or maintained at a relatively high temperature. Vapor deposition onto hot substrates causes impurities to diffuse out from the substrate and thereby affect, generally adversely, the composition of the thin film which is being deposited. While plasma processes do not generally require extremely high temperatures, deposition material will impinge on all surfaces within the deposition chamber, resulting in loss of valuable product. With all of these latterly described processes, deposition rates are difficult to control. Adhesion of the coatings produced by these processes is obtained not only by the same physical and chemical mechanisms as are operative with conventionally applied thin coatings but also by diffusion and chemical absorption of the deposition material into the substrate. Although these latterly discussed methods are accompanied by a deeper penetration of the coating material into the substrate, the fundamental character of the substrate surface remains unchanged. As is the case with thick film coatings and conventionally applied thin film coatings, there is a clear line of demarcation between the original substrate surface and the coating.

The present invention provides a novel method for the deposition of thin film organic coatings by ion beam implantation. In accordance with the invention, thin film organic coatings of a polymeric nature are deposited by ion beam implantation of an accelerated beam comprising ionized particles. More particularly, in accordance with the present invention, a flux comprising ions of organic deposition material is accelerated by electrostatic attraction due to an electric potential gradient or by collisional interaction with an energetic beam comprising ions of non-deposition material, ions of organic deposition material or ions of both organic deposition and non-deposition materials to deposit a thin film of organic deposition material having a polymeric nature in and on a substrate surface. Film deposition is accomplished by ionic implantation of at least a portion of ions of organic deposition material accompanied by polymerization and film growth resulting in surface and sub-surface bonding of deposited organic film material to the substrate. The thin film organic polymeric coatings of the invention are especially unique in that they appear to be merged into and with the substrate both on and within, as a result of ionic implantation, the substrate in such a manner that no distinct interface between the substrate species and the coating species is readily discernible. By contrast, prior art coatings, however deposited, show a clear line of demarcation between the substrate and the coating. While the phenomenon is not understood, a possible explanation could be that the implanted ionic specie, the polymeric species and atoms of the substrate species at the surface and near sub-surface of the substrate are bonded one to another through an electron-sharing mechanism.

Broadly, the present invention provides novel thin film organic coatings of a polymeric nature and methods for the deposition of such coatings. Thin film organic coatings of a polymeric nature are deposited in accordance with this invention by a process comprising (a) ionizing at least one vaporized monomeric organic material;

(b) energizing said ions of monomeric organic material;

(c) directing said energized ions of monomeric organic material against a surface of a substrate;

(d) impinging said energized ions of monomeric organic material against said substrate for a time sufficient to implant at least a portion of said energized ions into said substrate and deposit a thin film of organic material having a polymeric nature in and on said substrate, said implanted ions and film of organic material being merged into and onto said substrate surface.

In one embodiment of the invention, a source of organic deposition matter is ionized, focused into an ion beam, and the ion beam is energized through acceleration by electrostatic attraction due to an electric potential gradient. The accelerated energized beam of ions is directed onto a substrate material and impinged thereon for a time sufficient to (1) implant at least a portion of the ions of organic deposition matter into the substrate, thereby merging with atoms of substrate specie and, (2) grow a film of organic deposition material within said substrate and on the surface of said substrate.

In a second embodiment of the invention, a source of non-deposition matter is ionized, focused into an ion beam, and the ion beam is energized through acceleration by electrostatic attraction due to an electric potential gradient. The accelerated energized beam is directed into a deposition chamber containing vaporized organic deposition matter. In passing through the vaporized organic deposition matter, the energized accelerated beam comprising ions of non-deposition matter ionizes neutral atoms of organic deposition material through collisional interaction and the melange of ions of non-deposition matter and ions of organic deposition matter are coimpinged against the substrate, which is located within the deposition chamber, for a time sufficient to, (1), implant at least a portion of the ions of organic deposition matter into the substrate and, (2), grow a film of organic deposition material within said substrate and on the surface of said substrate. Alternatively, a melange of organic deposition matter and non-deposition matter can be ionized and energized through acceleration by electrostatic acceleration due to an electric potential gradient. The accelerated beam which is populated with ions of non-deposition matter and organic deposition matter is directed into a deposition chamber, which may or may not contain vaporized organic deposition matter, and impinged against one or more substrates located within said deposition chamber for a time sufficient to, (1), implant at least a portion of ions of organic deposition matter into the substrate and, (2), grow a film of organic deposition matter within said substrate and on the surface of the substrate. If desired, vaporized organic deposition matter can be supplied within the deposition chamber in any and all embodiments coming within the concept of the invention, In all cases in which vaporized organic deposition matter is present within the deposition chamber, the accelerated energized ion beam, which may or may not be populated with ions of organic deposition matter, provides the energy necessary to ionize such vaporized organic deposition matter through collisional interaction and to implant and otherwise deposit ions of organic deposition material into and on the substrate material. Mixtures of organic deposition material can be employed in any embodiment and, in cases wherein ions of organic deposition material are present in the accelerated energetic ion beam and generated in the deposition chamber through collisional interaction with the energetic beam, the organic deposition material furnishing such ions can be the same or different.

DETAILED DESCRIPTION OF THE DRAWINGS

Figure 1:
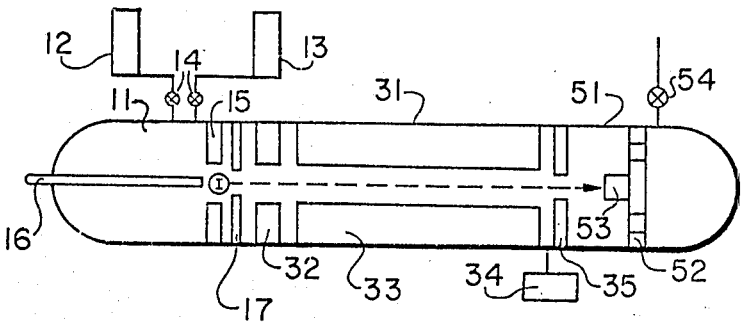
Figure 2:
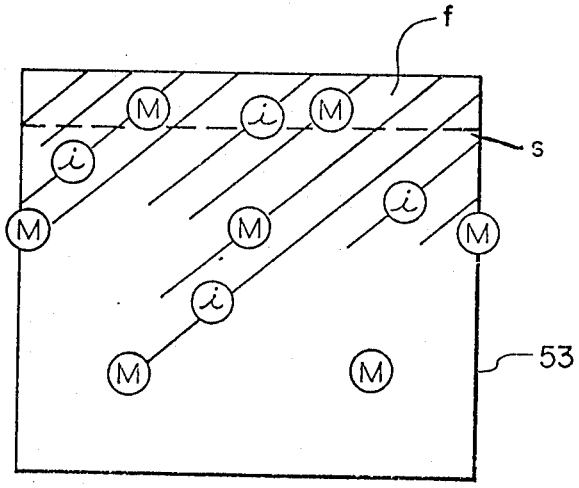

The invention will be fully understood from the following detailed description in combination with the accompanying drawings in which:

FIG. 1 is a diagrammatic illustration of a deposition system suitable for use in the practice of the invention; and FIG. 2 is a pictorial representation of a substrate treated in accordance with the present invention.

DETAILED DESCRIPTION OF THE DRAWINGS

Referring more specifically to FIG. 1, there is shown a deposition system 1 for modifying surfaces of substrate materials by the deposition by ion beam implantation of a thin film organic coating having a polymeric nature into and onto such surfaces. In particular, deposition system 1 comprises, in combination, an ion source chamber 11, an accelerator section 31 and a deposition chamber or gas cell 51. Ion source chamber 11 includes a source 12 of ionizable non-deposition matter which can be provided in vapor form to chamber 11 through flow control means 14. Chamber 11 can be provided with one or more source(s) 13 of ionizable organic deposition matter which can be provided, also in vapor form, to chamber 11 through flow control means 14. Chamber 11 also includes an ionizing means (not shown) for ionizing vaporized ionizable matter from either of sources 12 and 13, concentrating solenoid 15 and extraction electrode 16. Ionized material which is extracted from chamber 11 is passed through exit canal 17 into accelerator section 31, which comprises focusing means 32, accelerator means 33, vacuum means 34 and exit canal 35 through which the ionized material from chamber 11, which has been formed into an energetic beam of ions in accelerator section 31, is directed into deposition chamber 51. Deposition chamber 51 includes a substrate holder 52, attached to the inner wall of chamber 51 by means not shown, which is centrally positioned in line of sight of the outlet opening of exit canal 35 and upon which is placed substrate 53, and an auxiliary source, not shown, of deposition material, which can be provided in vapor form through flow control means 54 into chamber 51.

In operation, an ionizable substance in vapor form from either or both of sources 12 and 13 is introduced into ion source chamber 11, through flow control devices 14, which can be a palladium leak valve, a thermomechanical leak valve, Frit separator, remote-driven fine-flow needle valve, or other known type of flow regulating device. Neutral atoms of the ionizable substance, which can be either non-deposition matter or organic monomeric deposition matter or a mixture thereof, are ionized in chamber 11. As used herein, the term "non-deposition matter" refers to inorganic materials, which are ionizable and can be formed into a coherent beam of ions which is acceleratable by electrostatic attraction due to a potential gradient. Particularly suitable non-deposition materials include the noble gases such as argon and helium, as well as hydrogen, oxygen and nitrogen, with hydrogen being currently preferred. The term "organic monomeric deposition matter" refers to organic monomeric materials which are ionizable, can be formed into a coherent beam of ions which can be energized through acceleration by electrostatic attraction due to a potential gradient or by collisional interaction with other energetic ions and which can be implanted into a selected substrate and can deposit a film into and onto such substrate. Substantially any organic monomer which can be ionized can be employed in the practice of the invention as an organic monomeric deposition material, including both saturated and unsaturated organic compounds. Preferred compounds include hydrocarbons having at least one carbon atom, especially saturated hydrocarbon monomers having from one to 12 carbon atoms and, more especially, unsaturated hydrocarbon compounds having at least two carbon atoms, particularly olefins having from 2 to 12 carbon atoms and diolefins having from 4 to 12 carbon atoms. Ionization can be accomplished by any known technique, such as by electron bombardment from electrons emitted from a heated filament field emission, chemical ionization, or capillary arc, with radio frequency excitation being currently preferred.

Ionization in chamber 11 creates a flux or plasma containing a melange of electrons, positive ions, negative ions and neutral fragments, such as free radicals. The melange is concentrated at the exit end of chamber 11 by means of solenoid 15 and ions of the desired polarity (generally positive) are extracted by high voltage extraction electrode 16 and propelled through exit canal 17, formed of erosion-resistant material and directed through focusing system 32, a conventional focusing means such as a single lens Einzel focusing lens, which forms the extracted ions into a coherent ion beam I. Beam I is passed down accelerator section 31 past accelerator means 33, where the beam is accelerated by electrostatic attraction due to a potential gradient. Accelerator means 33 consists of a series of accelerating electrodes connected by a series of high voltage resistors. The resistors provide a continuous sequence of potential drops from the high voltage input terminal to ground potential at the exit of accelerator section 31. The acceleration means 33 must provide an acceleration energy to the ions populating the ion beam exiting chamber 11 of at least 10,000 electron volts (10 Kev), and preferably between 25 and 400 Kev.

The accelerated ion beam exits accelerator section 31 and is directed into deposition chamber 51 through exit canal 35, and impinges upon the target workpiece 53 which is located on a holder 52 secured to the inner wall of chamber 51. Chamber 51 can be filled with vaporized organic monomeric deposition matter. In such instances, the organic deposition matter is ionized by collisional interaction with the accelerated beam and its ions are coimpinged against the substrate, which is grounded to mitigate charge buildup, for a time sufficient to implant at least a portion of the ions of deposition material into the substrate and to deposit an organic film which is merged into and with the substrate.

Particles which tend to interfere with control and acceleration of the ion beam are removed from the deposition system by vacuum means 34, which is capable of maintaining an operating vacuum of at least $5\times10^{-6}$ torr. Accelerating the ion beam in a high vacuum reduces energy losses, ion scattering, loss of focusing, and other undesirable factors which preclude or inhibit the formation of a beam.

In FIG. 2 there is shown the coalesced organic film f which is merged into and with substrate 53, substrate atoms m and implanted ions i. The ions which populate beam I are provided with a large kinetic energy due to their acceleration by the electric field of acceleration means 33. The kinetic energy possessed by the beam ions serve two primary purposes: (1), ionization of vaporized organic deposition material, inert gas, or mixture of organic deposition material and inert gas which may be present in deposition chamber 51 through collisional interaction; and, (2), to inject or implant at least a portion of beam ions into the substrate material. The energy transferred as a result of collisional interactions with vaporized material in chamber 51 is sufficient to not only ionize at least a portion of vaporized material traversed by beam I but also to provide a kinetic energy to at least a portion of such newly-generated ions sufficient to cause the implantation of at least a portion thereof into the substrate material as they also impinge upon the substrate surface s. The ionic impingement not only results in the implantation of at least a portion of the total ion population which is present within chamber 51 into the substrate material but also in a sputtering and resultant cleaning of the surface of the substrate; and, simultaneously with these two processes, the deposition, coalescence and merging of the film with the atoms m of the substrate and the implanted ions i, with original substrate surface s becoming essentially indefinite, that is, not clearly defined.

In one embodiment of the invention employing an apparatus similar to that shown in FIG. 1, a thin polybutadiene film is coalesced onto and merged into and with a variety of substrates, including steel, aluminum, silver, glass and sodium chloride by ionizing non-organic non-film-forming gaseous species, including argon, neon, helium and hydrogen in chamber 11, employing radio frequency excitation to form a plasma comprising a flux of ions of such gaseous species. The ions are collimated into a coherent beam and accelerated to an energy level of at least 10 Kev, preferably at least 25 Kev and the beam is passed into deposition chamber 51 which contains vaporized 1,3-butadiene monomer. As the energetic beam of ions passes through the hydrocarbon atmosphere, a portion of the kinetic energy of the ion beam is transferred to the neutral hydrocarbon atoms to ionize the hydrocarbon and provide the resulting ions with sufficient kinetic energy to coimpinge with beam I onto the substrate, with the simultaneous ion implantation and film growth processes occurring at the surface of and within the substrate. Thin films of polyethylene are deposited by employing vaporized ethylene monomer in chamber 51. Polymer organic film are also produced by employing polymerizable organic monomers, such as ethylene and methane, as ion sources in chamber 11. In these embodiments, the same or different monomers are optionally present in chamber 51, as can be non-deposition species, such as argon, hydrogen or oxygen. Copolymeric organic films can be produced by employing mixed organic monomers, for example, ethylene can be used as a source of beam ions in chamber 11 with butadiene being present in chamber 51.

What is claimed is:

1. A method for the deposition of thin organic films comprising:

(a) ionizing at least one vaporized organic monomeric material;

(b) energizing said ions of vaporized organic monomeric material to an energy level of at least 10 Kev;

(c) directing said energized ions of vaporized organic monomeric material against a surface of a substrate selected from the group consisting of metals, glass and sodium chloride; and (d) impinging said energized ions of vaporized organic monomeric material against said substrate to implant at least a portion of such ions into said substrate and form a thin organic coating having a polymeric nature in and on said substrate, said formed polymeric coating being merged into and with implanted ions of vaporized organic monomeric material and with atoms of said substrate.

2. A method according to claim 1 wherein said thin organic film comprises organic polymeric material.

3. A method according to claim 2 wherein said organic polymeric material comprises a polymeric hydrocarbon.

4. A method according to claim 3 wherein said organic polymeric material comprises a polymer of a saturated hydrocarbon having from 1 to 12 carbon atoms.

5. A method according to claim 4 wherein said organic polymeric material comprises a polymer of methane.

6. A method according to claim 3 wherein said organic polymeric material comprises a polymer of an unsaturated hydrocarbon having from 2 to 12 carbon atoms.

7. A method according to claim 6 wherein said organic polymeric material comprises a polymer of an olefin having from 2 to 12 carbon atoms.

8. A method according to claim 7 wherein said organic polymeric material comprises a polymer of ethylene.

9. A method according to claim 6 wherein said organic polymeric material comprises a polymer of a diolefin having from 4 to 12 carbon atoms.

10. A method according to claim 9 wherein said organic polymeric material comprises a polymer of 1,3-butadiene.

11. A method according to claim 6 wherein said organic polymeric material comprises a polymer of a mixture of ethylene and 1,3-butadiene.

12. A method for the deposition of thin organic films comprising:

(a) ionizing at least one vaporized non-deposition material to form a flux comprising ions and neutral fragments of such vaporized non-deposition material;

(b) extracting from said flux an energetic beam consisting essentially of ions of vaporized non-deposition material;

(c) accelerating said energetic beam of ions of vaporized non-deposition material to an energy level of at least 10 Kev and directing said energetic beam of ions into a deposition chamber containing a substrate selected from the group consisting of metals, glass and sodium chloride, said deposition chamber containing also at least one vaporized monomeric organic deposition material;

(d) passing said energetic beam of ions of non-deposition material through said vaporized organic deposition material whereby such vaporized organic deposition material is ionized by collisional interaction with said energetic beam of ions of non-deposition material; and (e) coimpinging said energetic beam of ions of non-deposition material and ions of vaporized organic deposition material against a surface of said substrate for a time sufficient to implant at least a portion of said ions of vaporized organic deposition material into said substrate and to form a thin organic film having a polymeric nature in and on such substrate, such polymeric film being merged into and with ions of vaporized organic deposition material and the atoms of said substrate.

13. A method according to claim 12 wherein said organic deposition material comprises at least one hydrocarbon monomer.

14. A method according to claim 13 wherein said deposited film comprises a polymer of saturated hydrocarbon having at least 1 carbon atom.

15. A method according to claim 14 wherein said saturated hydrocarbon has from 1 to 12 carbon atoms.

16. A method according to claim 15 wherein said saturated hydrocarbon comprises methane.

17. A method according to claim 13 wherein said deposited film comprises a polymer of an unsaturated hydrocarbon having at least two carbon atoms.

18. A method according to claim 17 wherein said deposition film comprises a polymer of at least one olefin having from 2 to 12 carbon atoms.

19. A method according to claim 18 wherein said olefin comprises ethylene.

20. A method according to claim 17 wherein said deposited film comprises a polymer of at least one diolefin having from 4 to 12 carbon atoms.

21. A method according to claim 20 wherein said diolefin comprises 1,3-butadiene.

22. A method of the deposition of thin organic films comprising:

(a) ionizing a vaporized mixture consisting essentially of at least one non-deposition material and at least one first organic monomeric deposition material to form a flux comprising a melange of ions of vaporized non-deposition material and ions of vaporized first organic monomeric deposition material;

(b) extracting from said flux a beam consisting essentially of said melange of ions;

(c) energizing said beam through acceleration by electrostatic attraction due to a potential gradient to an energy level of at least 10 Kev and directing said energized beam into a deposition chamber containing a substrate selected from the group consisting of metals, glass and sodium chloride; and (d) impinging said energized beam against said substrate for a time sufficient to implant at least a portion of said ions of vaporized first organic deposition material into said substrate and to form a film of organic material having a polymeric nature in and on said substrate, said film of polymeric organic material being merged into and with implanted ions of vaporized first organic deposition material and with atoms of said substrate.

23. A method according to claim 22 wherein said deposited film of organic material comprises a polymer of at least one hydrocarbon monomer having at least one carbon atom.

24. A method according to claim 23 wherein said hydrocarbon monomer comprises at least one saturated hydrocarbon having from 1 to 12 carbon atoms.

25. A method according to claim 24 wherein said saturated hydrocarbon comprises methane.

26. A method according to claim 23 wherein said hydrocarbon monomer comprises at least one unsaturated hydrocarbon having at least two carbon atoms.

27. A method according to claim 26 wherein said unsaturated hydrocarbon comprises at least one olefin having from 2 to 12 carbon atoms.

28. A method according to claim 27 wherein said olefin is ethylene.

29. A method according to claim 26 wherein said unsaturated hydrocarbon comprises at least one diolefin having from 4 to 12 carbon atoms.

30. A method according to claim 29 wherein said diolefin comprises 1,3-butadiene.

31. A method according to claim 22 wherein there is present in said deposition chamber at least one second organic monomer deposition material in vapor form.

32. A method according to claim 31 wherein said vaporized second organic deposition material is ionized by said energized beam containing said melange of ions and said energized beam containing said melange of ions and said ions of vaporized second organic monomer deposition material are coimpinged against said substrate for a time sufficient to implant at least a portion of said ions of vaporized first organic monomeric deposition material and ions of vaporized second organic monomer deposition material into said substrate and to form a film of organic material having a polymeric nature into and on said substrate, said film of polymeric organic material being merged into and with implanted ions of said vaporized first organic monomeric deposition material and said vaporized second organic monomer deposition material and with atoms of said substrate.

33. A method according to claim 32 wherein said first organic deposition material and said second organic deposition material are the same.

34. A method according to claim 32 wherein said first organic deposition material and said second organic deposition material are different.

35. A method for the deposition of thin organic films comprising:

(a) ionizing at least one vaporized first organic monomeric deposition material to form a flux comprising ions of said vaporized first organic monomeric deposition material;

(b) extracting from said flux a beam consisting essentially of ions of vaporized first organic deposition material;

(c) energizing said beam of ions through acceleration by electrostatic attraction due to a potential gradient to an energy level of at least 10 Kev and directing said energized beam into a deposition chamber containing a substrate selected from the group consisting of metals, glass and sodium chloride; and (d) impinging said energized beam against said substrate for a time sufficient to implant at least a portion of said ions of vaporized first organic monomeric deposition material into said substrate and to form a film of organic material having a polymeric nature in and on said substrate, said film of polymeric organic material being merged into and with implanted ions of vaporized first organic monomeric deposition material and with atoms of said substrate.

36. The method of claim 35 wherein said first organic monomeric material comprises at least one hydrocarbon monomer.

37. The method of claim 36 wherein said hydrocarbon monomer combines at least one saturated hydrocarbon having from 1 to 12 carbon atoms.

38. The method of claim 37 wherein said hydrocarbon monomer comprises methane.

39. The method of claim 36 wherein said hydrocarbon monomer comprises at least one unsaturated hydrocarbon having at least 2 carbon atoms.

40. The method according to claim 39 wherein said unsaturated hydrocarbon monomer is selected from the group consisting of olefins having from 2 to 12 carbon atoms and diolefins having from 4 to 12 atoms.

41. The method according to claim 40 wherein said unsaturated hydrocarbon monomer comprises ethylene.

42. A method according to claim 35 wherein there is present in said deposition chamber at least one second organic monomeric deposition material in vapor form.

43. A method according to claim 42 wherein said vaporized second organic monomeric deposition material is ionized by collisional interaction with said energized beam consisting essentially of ions of vaporized first organic monomeric deposition material and said energized beam of ions and said ions of vaporized second organic monomeric deposition are coimpinged against said substrate for a time sufficient to implant at least a portion of said ions of vaporized first organic monomeric deposition material and said ions of vaporized second organic monomeric deposition material into said substrate and to form a film of organic material having a polymeric nature into and on said substrate, said film of polymeric organic material being merged into and with implanted ions of said vaporized first organic monomeric deposition material and said vaporized second organic monomeric deposition material and with atoms of said substrate.

44. A method according to claim 43 wherein said second organic material comprises at least one hydrocarbon monomer.

45. A method according to claim 43 wherein said first organic material and said second organic material are the same.

46. A method according to claim 45 wherein said first organic material comprises ethylene and said second organic material comprises ethylene.

47. A method according to claim 43 wherein said first organic material and said second organic material are different.

48. A method according to claim 47 wherein said first organic material comprises at least one olefin having from 2 to 12 carbon atoms and said second organic material comprises at least one diolefin having from 4 to 12 carbon atoms.

49. A method according to claim 48 wherein said first organic material comprises ethylene and said second organic material comprises 1,3-butadiene.

* * * * *